US006599326B1

(12) United States Patent
Seltzer et al.

(10) Patent No.: US 6,599,326 B1
(45) **Date of Patent: *Jul. 29, 2003**

(54) INHIBITION OF PULP AND PAPER YELLOWING USING HYDROXYLAMINES AND OTHER COADDITIVES

(75) Inventors: Raymond Seltzer, New City, NY (US); David Devore, Nyack, NY (US); Glen T. Cunkle, Stamford, CT (US); Cyril Heitner, Pierrefonds (CA); John A. Schmidt, L'ile Bizard (CA); Peter F. McGarry, L'ile Bizard (CA); Jean-Pierre Wolf, Courtaman (CH); Randall B. Nelson, Seattle, WA (US)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/481,665

(22) Filed: Jan. 12, 2000

Related U.S. Application Data

(60) Provisional application No. 60/116,688, filed on Jan. 20, 1999.

(51) Int. Cl.[7] ..... D06L 3/00; D21C 7/12

(52) U.S. Cl. ..... 8/101; 8/107; 8/110; 162/158; 162/100; 162/91; 167/70; 167/71; 167/76; 167/77; 167/81; 167/162

(58) Field of Search ..... 8/101, 107, 110; 162/158, 100, 91; 167/70, 71, 76, 77, 81, 162

(56) References Cited

U.S. PATENT DOCUMENTS

| | | | | |
|---|---|---|---|---|
| 4,612,393 A | | 9/1986 | Ravichandran et al. | 564/300 |
| 4,720,517 A | | 1/1988 | Ravichandran et al. | 524/101 |
| 5,019,285 A | | 5/1991 | Evans et al. | 252/47.5 |
| 6,103,059 A | * | 8/2000 | Call | 162/65 |
| 6,254,724 B1 | | 7/2001 | Seltzer et al. | 162/70 |

FOREIGN PATENT DOCUMENTS

| | | |
|---|---|---|
| CA | 2164394 | 6/1996 |
| WO | 97/36041 | 10/1997 |

OTHER PUBLICATIONS

Application Ser. No. 09/483,017.
Application Ser. No. 09/234,253.
I. E. Arakin et al., Khimiya drevesiny (Chemistry of Wood), 1982, No. 2, 114.
A. D. Sergeev et al., Khimiya drevesiny (Chemistry of Wood), 1984, No. 5, P.20–22.
V. I. Khodyrev et al., Vysokomol soyed, A29, No. 3, 616 (1987) [Polymer Sci. U.S.S.R., 29, No. 3, 688 (1987)].
M–K. Syler et al., J. Assn. Paper Pulp Tech., 29, 135 (1990).
P. Fornier de Violet et al., Cellulose Chem. Tech., 24, 225 (1990).
R. Agnemo et al., 6$^{th}$ International Symposium on Wood and Pulping Chemistry, Appita, 1991.
S. Omori et al., J. Assn. Paper Pulp Tech., 48, 1388 (1993).
A.I. Mikhailov, et al. 8$^{th}$ International Symposium Wood and Pulping Chemistry, Helsinki, 1995.
Z–H. Wu et al., Holzforschung, 48, (1994), 400.
C. Heitner, Chemistry of Brightness Reversion and It Control, Chapter 5, TAPPI, Atlanta, 1996, pp. 183–211.

* cited by examiner

*Primary Examiner*—Mark Kopec
*Assistant Examiner*—Derrick G. Hamlin
(74) *Attorney, Agent, or Firm*—Tyler A. Stevenson; Luther A. R. Hall

(57) ABSTRACT

Chemical pulps or papers, especially kraft pulps or papers, which may still contain traces of lignin, have enhanced resistance to yellowing when they contain an effective stabilizing amount of a N,N-dialkylhydroxylamine, an ester, amide or thio substituted N,N-dialkylhydroxylamine or N,N-dibenzylhydroxylamine or an amminium salt thereof. This performance is often further enhanced by the presence of one or more coadditives selected from the group consisting of the UV absorbers, the polymeric inhibitors, the nitrones, the fluorescent whitening agents and metal chelating agents. Combinations of hydroxylamines or their salts, benzotriazole or benzophenone UV absorbers and a metal chelating agent are particularly effective. N,N-Diethylhydroxylamine and N,N-dibenzylhydroxylamine and their acid salts are surprisingly effective for this purpose.

43 Claims, No Drawings

INHIBITION OF PULP AND PAPER YELLOWING USING HYDROXYLAMINES AND OTHER COADDITIVES

This application claims the benefit under 35 USC 119(e) of U.S. Provisional Application No. 60/116,688, filed on Jan. 20, 1999.

The instant invention pertains to a method for preventing the loss of brightness and for enhancing resistance to yellowing in pulp or paper, particularly pulp or paper which may still contain traces of lignin, by the addition of N,N-dialkylhydroxylamines, an ester, amide or thio substituted N,N-dialkylhydroxylamine or N,N-dibenzylhydroxylamine, or their salts and other coadditives.

BACKGROUND OF THE INVENTION

High-yield and ultra-high yield wood pulps undergo rapid light-induced discoloration, particularly when they are exposed to near ultraviolet light (wave lengths 300–400 nm) in indoor fluorescent light and daylight. This characteristic restricts their use to short-life, low-value paper products. High-yield and ultra-high yield wood pulps can be bleached to a high level of whiteness. If this whiteness could be stabilized against discoloration, these bleached high-yield pulps could displace significant amounts of more expensive fully-bleached, low-yield chemical pulps.

This discoloration is ascribed to the substantial lignin content of high-yield pulps totally about 20–30% by mass. Phenoxy radicals are the key intermediates in the reaction mechanism. Several light-induced reactions have been proposed to account for their formation such as cleavage of the aryl ether bond of phenacyl aryl ether groups, or breakdown of ketyl radicals formed from saturated aryl-glycerol β-aryl ether structures in lignin. The phenoxy radicals are oxidized by other oxygen-centered radicals (alkoxy and perhydroxy) to form yellow chromophores.

I. E. Arzkin et al., Khymiya drevesiny (Chemistry of Wood), 1982, No. 2, 114 and A. D. Sergeev et al., ibid, 1984, No. 5, 20 disclosed that the use of iminoxyl radicals such as TEMPO (1-oxyl-2,2,6,6-tetramethylpiperidine) is useful in the delignification of wood using the one-stage oxygen-soda (alkaline) process, but made no mention or suggestion of any activity provided by TEMPO on preventing light-induced discoloration of paper or pulp made from such treated wood.

V. 1. Khodyrev et al., Vysokomol soyed, A29, No. 3, 616 (1987) [Polymer Sci. U.S.S.R., 29, No. 3, 688 (1987)] show that the photoinitiated oxidation by oxygen causes weathering of cellulosic textile materials such as flax or cotton, and that the light stability of the cellulose could be improved by photostabilizers such as the UV absorbers, benzophenols and 1-oxyl-2,2,6,6-tetramethylhydroxypiperidine. The UV absorbers offer no protection, and are actually detrimental. The authors noted that the stable nitroxyl radical interacts with alkyl radicals in the cellulose to afford its salubrious stabilizing activity. There is no suggestion by the authors that this stabilizing activity could be applied successfully in wood pulp and/or paper made therefrom.

M-K. Syler et al., J. Assn. Paper Pulp Tech, 29, 135 (1990) show that selected metal salts such as magnesium sulfate and lower alkanoic acids inhibit color reversion in bleached pulp.

P. Fomier de Violet et al., Cellulose Chem. Tech., 24, 225 (1990) show that the use of UV absorbers and hydrogen donor agents such as thiols, ascorbic acid, etc. help prevent the photoinduced discoloration of hydrogen peroxide bleached wood pulp, but that chain breakers such as hindered phenols and hindered amines (having >N—H or >N—$CH_2$— moieties) had no or even a detrimental effect on preventing photoinduced discoloration.

R. Agnemo et al., 6th International Symposium on Wood and Pulping Chemistry, Appita, 1991, confirmed that free hydroxyl radicals plus lignin lead to undesirable photoyellowing in pulp and paper.

S. Omori et al., J. Assn. Paper Pulp Tech, 48, 1388 (1993) describes the effect of antioxidants and UV absorbers on light reversion and concludes that the combination of an antioxidant and UV absorber prevents color reversion and has a synergistic effect in that activity.

M. Paulsson et al., 8th International Symposium Wood and Pulping Chemistry, Helsinki, 1995, show that efficient photostabilization of unbleached paper or hydrogen peroxide bleached TMP pulp can be achieved by acetylation.

There have been a number of different approaches proposed to inhibiting the yellowing of mechanical pulps. These include: radical scavengers and antioxidants; UV screens; elimination of chromophores after their formation; chemical modification of lignin by alkylation or acetylation; polymeric inhibitors; and two types of coadditives used in combination. Z-H. Wu et al., Holzforschung, 48, (1994), 400 discuss the use of radical scavengers like phenyl-N-tert-butylnitrone to reduce the formation of chromophores during mechanical pulping and give a more light-stable pulp.

C. Heitner, Chemistry of Brightness Reversion and It Control, Chapter 5, TAPPI, Atlanta, 1996, pp 183–211, summarizes the state of the art in the thermal and light-induced yellowing of lignin-containing pulps such as thermomechanical (TMP) and chemithermomechical (CTMP) pulps, showing the seriousness of these undesirable effects discusses generally the then current prior art methods used to attack this problem. These include bleaching, the use of phosphites, UV absorbers, polyalkylene glycols and free radical scavengers such as ascorbic acid, thiols, thioethers, dienes and aliphatic aldehydes and chelating agents such as ethylenediaminetetraacetic acid (EDTA). The author concluded that, although much progress had been made, much still remains to be done before a successful and practical solution to this loss of brightness and undesirable yellowing of lignin-containing pulp and/or paper is found.

Copending application Ser. No. 09/119,567 describes a potential solution where the use of selected hindered amine nitroxides, hindered amine hydroxylamines or their salts in combination with selected UV absorbers and metal chelating agents is seen to prevent loss of brightness and to enhance resistance to yellowing in chemimechanical or thermomechanical pulp or paper still containing lignin.

Canadian Patent Application No. 2,164,394 and WO 97/36041 teach a multi-component system for modifying, degrading or bleaching lignin-containing materials. This system includes an oxidation catalyst as an essential component. The catalysts are selected enzymes such as oxidoreductases of classes 1.1.1 to 1.97. The system also includes a number of mediators which inter alia include lower N,N-dialkylhydroxylamines and N,N-dibenzylhydroxylamine.

The instant invention describes another approach to this important problem where the use of N,N-dialkylhydroxylamine, an ester, amide or thio substituted N,N-dialkylhydroxylamine or N,N-dibenzylhydroxylamine or their salts in combination with selected coadditives also prevents the loss of brightness and enhances resistance to yellowing in pulp or paper, especially pulp or paper still containing lignin. The ester, amide or thio substituted N,N-dialkyl-hydroxylamines are described in U.S. Pat. Nos. 4,612,393; 4,720,517 and 5,019,285.

DETAILED DESCRIPTION OF THE INVENTION

Hydroxylamines are known to be efficient free radical traps and may limit the production of o-quinones; UV absorbers limit photochemistry in the underlying substrate to which they are applied, and ultimately reduce the production of free radicals. UV absorbers and hydroxylamines are each effective at stemming some of the free radical chemistry leading to paper yellowing when used singly. However, when they are used together, hydroxylamines and UV absorbers can act synergistically to effectively stop photochemical yellowing of lignin containing papers. The hydroxylamines show enhanced inhibiting activity when combined with a metal chelating agent such diethylenetriaminepentaacetic acid or citric acid, or polymeric inhibitors such as polyethylene glycol.

More particularly, the instant invention pertains to a composition having enhanced resistance to yellowing which comprises (a) a chemical pulp or paper, especially a kraft pulp or paper, which may still contain traces of lignin, and (b) an effective stabilizing amount of an N,N-dialkylhydroxylamine, an ester, amide or thio substituted N,N-dialkylhydroxylamine or N,N-dibenzylhydroxylamine of formula I, II or III

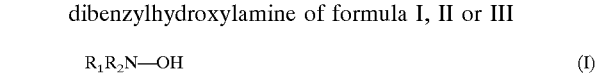

$$R_1R_2N—OH \quad (I)$$

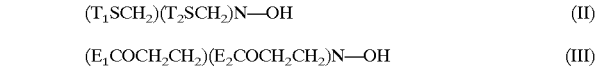

$$(T_1SCH_2)(T_2SCH_2)N—OH \quad (II)$$

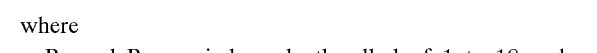

$$(E_1COCH_2CH_2)(E_2COCH_2CH_2)N—OH \quad (III)$$

where $R_1$ and $R_2$ are independently alkyl of 1 to 18 carbon atoms, alkyl of 1 to 18 carbon atoms substituted by a hydroxyl group; or benzyl;

$T_1$ and $T_2$ are independently alkyl of 1 to 4 carbon atoms, phenyl, 3,5-di-tert-butyl-4-hydroxyphenyl, benzyl or —$CH_2COOH$;

$E_1$ and $E_2$ are independently —$OE_3$, —$NHE_3$ or —$NE_3E_4$ where $E_3$ and E4 are independently hydrogen, alkyl of 1 to 4 carbon atoms or said alkyl substituted by one hydroxyl group; or of an acid salt of formula IA, IIA or IIIA

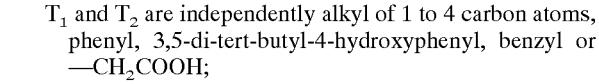

$$(R_1R_2NH—OH)_h^+(X)_j \quad (IA)$$

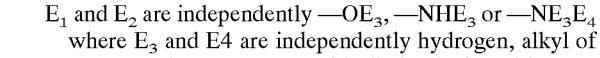

$$[(T_1SCH_2)(T_2SCH_2)NH—OH]_h^+(X^-)_j \quad (IIA)$$

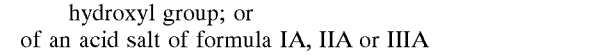

$$[(E_1COCH_2CH_2)(E_2COCH_2CH_2)NH—OH]_h^+(X^-)_j \quad (IIIA)$$

where

X is an inorganic or organic anion, and the total charge of cations h is equal to the total charge of anions j.

Preferably, X is phosphate, phosphonate, carbonate, bicarbonate, nitrate, chloride, bromide, bisulfite, sulfite, bisulfate, sulfate, borate, formate, acetate, benzoate, citrate, oxalate, tartrate, acrylate, polyacrylate, fumarate, maleate, itaconate, glycolate, gluconate, malate, mandelate, tiglate, ascorbate, polymethacrylate, a carboxylate of nitrilotriacetic acid, hydroxyethylethylenediaminetriacetic acid, ethylenediaminetetraacetic acid or of diethylenetriaminepentaacetic acid, a diethylenediaminetetraacetic acid or of diethylenetriaminepentaacetic acid, an alkylsulfonate or an arylsulfonate.

Preferably the hydroxylamine is N,N-dimethylhydroxylamine, N,N-diethylhydroxylamine, N,N-bis(2-hydroxypropyl)hydroxylamine, N,N-bis(3-hydroxypropyl)hydroxylamine, N,N-dioctadecylhydroxylamine, the N,N-dialkylhydroxylamine product made by the direct oxidation of N,N-di(hydrogenated tallow)amine, N,N-dibenzylhydroxylamine, N,N-bis(2-carboxyethyl)-hydroxylamine or N,N-bis(benzylthiomethyl)hydroxylamine.

Most preferably, the hydroxylamine is N,N-diethylhydroxylamine, N,N-bis(2-hydroxypropyl)hydroxylamine, N,N-bis(3-hydroxypropyl)hydroxylamine or N,N-dibenzylhydroxylamine.

Most especially, the hydroxylamine or hydroxylamine salt is N,N-diethylhydroxylamine or tris(N,N-diethylhydroxylammonium) citrate.

The effective stabilizing amounts of the hydroxylamine is 0.001 to 5% by weight based on the pulp or paper. Preferably, the effective stabilizing amount is 0.005 to 4% by weight; preferably 0.01 to 4% by weight.

When a coadditive stabilizer is also present, the effective stabilizing amount of the coadditives is also 0.001 to 5% by weight based on the pulp or paper; preferably 0.005 to 3% by weight; most preferably to 2% by weight.

The instant compounds may additionally include an effective stabilizing amount of at least one stabilizer selected from the group consisting of the UV absorbers, the polymeric inhibitors, the sulfur containing inhibitors, the phosphorus containing compounds, the nitrones, the benzofuran-2-ones, fluorescent whitening agents, hindered amine hydroxylamines and salts thereof, hindered amine nitroxides, hindered amines and salts thereof and metal chelating agents.

The compositions which also include a UV absorber are especially preferred. The UV absorber is selected from group consisting of the benzotriazoles, the s-triazines, the benzophenones, the α-cyanoacrylates, the oxanilides, the benzoxazinones, the benzoates and the α-alkyl cinnamates.

Preferably, the UV absorber is a benzotriazole, an s-triazine or a benzophenone, most especially a benzotriazole UV absorber or benzophenone UV absorber.

Typical and useful UV absorbers are, for example,

5chloro-2-(2-hydroxy-3,5-di-tert-butylphenyl)-2H-benzotriazole;

2-(2-hydroxy-3,5di-tert-butylphenyl)-2H-benzotriazole;

2-(2-hydroxy-3,5-di-tert-amylphenyl)-2H-benzotriazole;

2-(2-hydroxy-3,5di-acumylphenyl)2H-benzotriazole;

2-(2-hydroxy-3α-cumyl-5-tert-octylphenyl)-2H-benzotriazole;

2-(2-hydroxy-5tert-octylphenyl)-2H-benzotriazole;

2-(2-hydroxy-3-tert-butyl-5-methylphenyl)-2H-benzotriazole-5-sulfonic acid, sodium salt;

3-tert-butylhydroxy-5-(2H-benzotriazol-2-yl)-hydrocinnamic acid;

12-hydroxy-3,6,9trioxadodecyl 3-tert-butylhydroxy-5-(2H-benzotriazol-2-yl)-hydro-cinnamate;

octyl 3-tert-butyl-4-hydroxy-5-(2H-benzotriazol-2-yl)-hydrocinnamate;

4,6bis(2,4-dimethylphenyl)-2-(4-(3-dodecyloxy*-2-hydroxypropoxy)-2-hydroxyphenyl)-s-triazine (*is mixture of $C_{12-14}$oxy isomers);

4,6-bis(2,4-dimethylphenyl)-2-(40octyloxy-2-hydroxyphenyl)-s-triazine;

2,4dihydroxybenzophenone;

2,2',4,4'-tetrahydroxy-5,5'-disulfobenzophenone, disodium salt;

2-hydroxy4octyloxybenzophenone;

2-hydroxy4-dodecyloxybenzophenone;

2,4-dihydroxybenzophenone-5-sulfonic acid and salts thereof;

2-hydroxy4methoxybenzophenone-5-sulfonic acid and salts thereof;

2,2'-dihydroxy4,4'dimethoxybenzophenone-5,5'-disodium sulfonate; and 3-(2H-benzotriazol-2-yl)-hydroxy-5-sec-butylbenzenesulfonic acid, sodium salt (CIBAFASR® W).

Other preferred compositions are those which additionally contain a polymeric inhibitor; preferably poly(ethylene glycol), poly(propylene glycol), poly(butylene glycol) or poly(vinyl pyrrolidone).

Still other preferred compositions wherein the additional stabilizer is a sulfur containing inhibitor; preferably polyethylene glycol dithiolacetate, polypropylene glycol dithiolacetate, polybutylene glycol dithioacetate, 1-thioglycerol, 2-mercaptoethyl ether, 2,2'thiodiethanol, 2,2'-dithiodiethanol, 2,2'oxydiethanethiol, ethylene glycol bisthioglycolate, 3-mercapto-1,2-propanediol, 2-(2-methoxyethoxy)-ethanethiol, glycol dimercaptoacetate, 3,3'-dithiopropionic acid, polyethylene glycol dithiol, polypropylene glycol dithiol, polybutylene glycol dithiol or ethylene glycol bis(mercaptoacetate).

Other preferred compositions are those wherein the additional stabilizer is a phosphorus containing compound; preferably tris(2,4di-tert-butylphenyl) phosphite, 2,2',2"-nitrilo [triethyl-tris(3,3',5,5'-tetra-tert-butyl-1,1'-biphenyl-2,2'-diyl) phosphite], bis(2,4-di-tert-butyl-6methylphenyl) ethyl phosphite, sodium hydroxymethyl phosphinate, tetrakis(2,4di-butylphenyl) 4,4'-biphenylenediphosphonite, tris (nonylphenyl) phosphite, bis(2,4-di-tert-butylphenyl) pentaerythrityl diphosphite, 2,2'-ethylidenebis(2,4-di-tert-butylphenyl) fluorophosphite or 2-butyl-2-ethylpropan-1,3-diyl 2,4,6-tri-tert-butylphenyl phosphite.

Still other preferred compositions are those wherein the additional stabilizer is a benzo-furan-2-one; preferably 5,7-di-tert-butyl-3-(3,4dimethylphenyl)-2H-benzofuran-2-one.

Still other preferred composition are those wherein the additional stabilizer is a metal chelating agent; preferably citric acid, keto acids, gluconates, heptagluconates, phosphates, phosphonates and aminocarboxylic acid chelates, such as ethylenediaminetetraacetic acid (EDTA), diethylenetriaminepentaacetic acid (DTPA), hydroxyethylethlenediaminetriacetic acid (HEDTA), nitrilotriacetic acid (NTA) and diethylenetriaminepentamethylenephosphonic acid (DTPMPA).

Some preferred compositions contain a mixture of additional stabilizers such as a mixture of a UV absorber and polymeric inhibitor; or a mixture of a UV absorber and a sulfur containing compound; or a mixture of a UV absorber and a phosphorus containing compound; or a mixture of a UV absorber and a metal chelating agent; or a mixture of a polymeric inhibitor and a sulfur containing compound; or a mixture of a polymeric inhibitor and a phosphorus containing compound; or a mixture of a sulfur containing compound and a phosphorus containing compound; or a mixture of a UV absorber, a polymeric inhibitor and a sulfur containing compound; or a mixture of a UV absorber, a polymeric inhibitor and a phosphorus containing compound; or a mixture of a UV absorber, a polymeric inhibitor, a sulfur containing compound and a phosphorus containing compound; or a mixture of a UV absorber, a polymeric inhibitor and a metal chelating agent.

Some preferred compositions are those wherein the additional stabilizer is a mixture of a hindered amine hydroxylamine or hindered amine hydroxylamine salt with at least one other stabilizer in the group consisting of the UV absorbers, the polymeric inhibitors, the sulfur containing inhibitors, the phosphorus containing compounds, fluorescent whitening agents, brighteners, metal chelating agents and hindered amine nitroxides and salts thereof.

Some preferred composition are those wherein the additional stabilizer is a mixture of a hindered amine hydroxylamine with at least one fluorescent whitening agent such as 2,2'-[(1,1'-diphenyl)4,4'-diyl-1,2-ethenediyl]bis-benzenesulfonic, disodium salt {or bis[4,4'-(2-stilbenesulfonic acid)], disodium salt} which is TINOPAL® SK, Ciba.

Preferably the compositions are those wherein the compound of formula I, II, III, IA, IIA or IIIA is of low molecular weight or contains hydrophilic moieties or is both of low molecular weight and contains hydrophilic moieties.

The instant invention also pertains to a process for preventing the loss of brightness and for enhancing resistance to yellowing of a chemical pulp or paper, particularly a kraft pulp or paper, which may still contain traces of lignin, which comprises treating said pulp or paper with an effective stabilizing amount of a compound of formula I, II or III, or formula IA, IIA or IIIA as described above.

The instant inhibitor additive system can be added to pulp or paper at a number of places during the manufacturing or processing operations. These include a. on a pulp slurry in the latency chest;

b. on a pulp slurry in or after the bleaching stage in a storage, blending or transfer chest;

c. on pulp during or after bleaching, washing and dewatering followed by cylinder or flash drying;

d. before or after the cleaners;

e. before or after the fan pump to the paper machine headbox;

f. to the paper machine white water;

g. to the silo or save all;

h. in the press section using a size press, coater or spray bar;

i. in the drying section using a size press, coater or spray bar;

j. on the calender using a wafer box;

k. on paper in an off-machine coater or size press; and/or l. in the curl control unit.

Clearly, the precise location where the stabilizer additives should be added will depend on the specific equipment involved, the exact process conditions being used and the like. In some cases, the additives may be added at one or more locations for most effectiveness.

If the stabilizer or other coadditives are not themselves "water-soluble", they may be dispersed or emulsified by standard methods prior to application. Alternatively, the stabilizer and/or coadditives may be formulated into a paper sizing or paper coating formulation.

The following examples are for illustrative purposes only and are not to be construed to limit the instant invention in any manner whatsoever.

Handsheet Treatment

All additives are applied by syringe-injecting the appropriate weight % of additive combination in either an aqueous solution when the additive is water soluble, or a solution in 1:1 ethanol/dioxane, onto bleached thermomechanical pulp (BTMP) brightness squares (4 cm×4 cm). The clamped sheets are allowed to air dry for one day.

The brightness of the handsheets is recorded before and after treatment by light exposure under controled intensity conditions.

Accelerated testing is carried out by subjecting the treated sheets to accelerated light induced yellowing in a fan-cooled light box containing eight fluorescent lamps with a spectral maximum output at 5700 Å with a total output approximately 43 times greater than normal office fluorescent lamps. The lamps are about ten inches away from the handsheets being illuminated.

Ambient testing is carried out by placing the treated handsheets on a desk under normal cool-white fluorescent office lights at a nominal distance of six feet.

In both cases, ISO brightness is tracked as a function of photolysis time and converted to post color number (PC number) in the usual manner.

Post color (PC) number is defined as follows:

$$PC=[(k/s)_{after}-(k/s)_{before}]\times 100$$

$$k/s=(1-R_{inf})^2/2R_{inf}$$

where k and s are the absorption and scattering coefficients, respectively, and $R_{inf}$ is the value of ISO brightness.

The relationship between $R_{inf}$ and the chromophore concentration is non-linear, whereas, the PC number is roughly linearly related to the concentration of the chromophore in the sample.

Low PC numbers are desired as they indicate less yellowing.

When, using the ambient test conditions, untreated BTMP handsheets are compared to Kraft handsheets after 60 days, the BTMP handsheets have a PC number which is about 10 while the Kraft paper has a PC number which is about 0.39. The Kraft handsheets are clearly less yellow than untreated BTMP handsheets after exposure to ambient light.

The incident light flux for the accelerated yellowing experiments (Examples 1–10) is 43 times greater than normal office fluorescent lamps as measured by the A. W. Speery SLM-110 digital light power meter. The brightness of the handsheets is tracked and compared to that of untreated sheets exposed in the same manner. The treated sheets exhibit significant resistance to yellowing as is seen below.

Materials Used in the Examples

Compound A is N,N-diethylhydroxylamine.

Compound B is N,N-dibenzylhydroxylamine.

Compound C is N,N-dioctadecylhydroxylamine.

Compound D is the N,N-dialkylhydroxylamine product made by the direct oxidation of N,N-di(hydrogenated tallow)amine.

Compound E is tris(N,N-diethylhydroxylammonium) citrate.

PEO is poly(ethylene glycol) of molecular weight 300.

TINUVIN® 8 328 (Ciba) is 2-(2-hydroxy-3,5-di-tert-amylphenyl)-2H-benzotriazole.

TINOPAL® SK (Ciba) is 2,2'-[(1,1'-diphenyl)-4,4'-diyl-1,2-ethenediyl]bis-benzenesulfonic, disodium salt {or bis[4,4'-(2-stilbenesulfonic acid)], disodium salt}.

CIBAFAST® W (Ciba) is 3-(2H-benzotriazol-2-yl)-4-hydroxy-5sec-butylbenzenesulfonic acid, sodium salt.

Compound F is N,N-bis(2-carboxyethyl)hydroxylamine.

Compound G is N,N-bis(benzylthiomethyl) hydroxylamine.

EXAMPLE 1

Accelerated Yellowing With High Intensity Lamps

Handsheets made from a kraft pulp bleached using a total chlorine free (TCF) process are treated with 0.1% by weight of N,N-diethylhydroxylamine (Compound A) or with 0.1% by weight of N,N-dibenzylhydroxyamine (Compound B). The treated sheets exhibit a substantial inhibition of yellowing compared to the untreated control sheet as seen by the PC numbers given in the table below. Lower PC numbers indicate less color.

| Time in Days | Blank | 0.1% Compound A | 0.1% Compound B |
|---|---|---|---|
| 0 | 0 | 0 | 0 |
| 3 | 0.26 | 0.20 | 0.25 |
| 4 | 0.29 | 0.23 | 0.28 |
| 7 | 0.35 | 0.28 | 0.33 |
| 11 | 0.36 | 0.27 | 0.31 |
| 14 | 0.36 | 0.29 | 0.30 |
| 18 | 0.35 | 0.29 | 0.31 |
| 21 | 0.41 | 0.30 | 0.32 |
| 25 | 0.43 | 0.34 | 0.35 |

These data show that the kraft sheets discolor perceptibly less when N,N-dibenylhydroxylamine and especially when N,N-diethylhydroxylamine are present.

EXAMPLE 2

Accelerated Yellowing With High Intensity Lamps

A kraft sheet is treated with 0.3% by weight of Compound B and 2.0% by weight of poly(ethylene glycol), molecular weight 300 (PEO). Again, the treated sheet exhibits an excellent resistance to yellowing as compared to the untreated control sheet.

EXAMPLE 3

Accelerated Yellowing With High Intensity Lamps

A kraft sheet is treated with 0.3% by weight of Compound C and 1.0% by weight of 2-(2-hydroxy-3,5di-tert-amylphenyl)-2H-benzotriazole (TINUVIN® 328, Ciba). The treated sheet shows surprisingly excellent resistance to yellowing especially in contrast to the untreated control sheet.

EXAMPLE 4

Accelerated Yellowing With High Intensity Lamps

A kraft sheet is treated with 0.6% by weight of Compound D, 2.0% by weight of poly(ethylene glycol), molecular weight 300 (PEO), and 1.0% by weight of 2-(2-hydroxy-3,5di-tert-amylphenyl)-2H-benzotriazole (TINUVIN® 328, Ciba). The treated sheet shows extraordinary resistance to yellowing especially in contrast to the untreated control sheet.

EXAMPLE 5

Accelerated Yellowing With High Intensity Lamps

A kraft sheet is treated with 0.3% by weight of Compound A and 1.0% by weight of TINOPAL® SK. Again, the treated sheet exhibits an excellent resistance to yellowing as compared to the untreated control sheet.

EXAMPLE 6

Accelerated Yellowing With High Intensity Lamps

Handsheets made from a kraft pulp bleached using an elemental chlorine free (ECF) process are treated with 0.1% by weight of N,N-diethylhydroxylamine (Compound A) or with 0.1% by weight of N,N-dibenzylhydroxyamine (Compound B) and each with 0.5% of 3-(2H-benzotriazol-2-yl)-4-hydroxy-5-sec-butylbenzenesulfonic acid, sodium salt (CIBAFAST® W). The treated sheets exhibit a substantial inhibition of yellowing compared to the untreated control sheet as seen by the PC numbers given in the table below. Lower PC numbers indicate less color.

| Time in Days | Blank | 0.5% CIBAFAST ® W 0.1% Compound A | 0.5% CIBAFAST ® W 0.1% Compound B |
|---|---|---|---|
| 0 | 0 | 0 | 0 |
| 3 | 0.36 | 0.18 | 0.32 |
| 4 | 0.41 | 0.22 | 0.38 |
| 7 | 0.49 | 0.28 | 0.45 |
| 11 | 0.50 | 0.26 | 0.44 |
| 14 | 0.48 | 0.25 | 0.44 |
| 18 | 0.50 | 0.27 | 0.44 |
| 21 | 0.53 | 0.28 | 0.46 |
| 25 | 0.58 | 0.31 | 0.50 |

These data show that the kraft sheets discolor perceptibly less when N,N-dibenylhydroxylamine and especially when N,N-diethylhydroxylamine are present along with the UV absorber CIBAFAST® W.

EXAMPLE 7

A kraft sheet is treated with 0.33% and with 0.66% by weight of N,N-diethylhydroxylamine (Compound A) and 0.5% by weight of CIBAFAST® and then exposed to accelerated aging as described above. The treated sheet exhibits a substantial inhibition of yellowing compared to the untreated control sheet.

EXAMPLE 8

A kraft sheet is treated with 0.33% and with 0.66% by weight of tris(N,N-diethylhydroxylammonium) citrate (Compound E) and 0.5% by weight of CIBAFAST® and then exposed to accelerated aging as described above. The treated sheet exhibits a substantial inhibition of yellowing compared to the untreated control sheet.

EXAMPLE 9

A kraft sheet is treated with 1.0% by weight of N,N-bis (2-carboxyethyl)hydroxylamine (Compound F) and 1.0% by weight of CIBAFAST® and then exposed to accelerated aging as described above. The treated sheet exhibits a substantial inhibition of yellowing compared to the untreated control sheet.

EXAMPLE 10

A kraft sheet is treated with 1.0% by weight of N,N-bis (benzylthiomethyl)hydroxylamine (Compound G) and 1.0% by weight of CIBAFAST® and then exposed to accelerated aging as described above. The treated sheet exhibits a substantial inhibition of yellowing compared to the untreated control sheet.

EXAMPLE 11

Accelerated Yellowing With High Intensity Lamps

Handsheets made from a kraft pulp bleached using a total chlorine free (TCF) process are treated with 0.1% by weight of N,N-diethylhydroxylamine (Compound A) or with 0.1% by N,N-dibenzylhydroxyamine (Compound B) and each with 0.5% of 3-(2H-benzotriazol-2-yl)-4-hydroxy-5sec-butylbenzenesulfonic acid, sodium salt (CIBAFAST® ). The treated sheets exhibit a substantial inhibition of yellowing compared to the untreated control sheet as seen by the PC numbers given in the table below. Lower PC numbers indicate less color.

| Time in Days | Blank | 0.5% CIBAFAST ® W 0.1% Compound A | 0.5% CIBAFAST ® W 0.1% Compound B |
|---|---|---|---|
| 0 | 0 | 0 | 0 |
| 3 | 0.26 | 0.06 | 0.13 |
| 4 | 0.29 | 0.08 | 0.16 |
| 7 | 0.36 | 0.11 | 0.21 |
| 11 | 0.36 | 0.10 | 0.22 |
| 14 | 0.36 | 0.10 | 0.22 |
| 18 | 0.35 | 0.11 | 0.26 |
| 21 | 0.41 | 0.12 | 0.28 |
| 25 | 0.43 | 0.15 | 0.30 |

These data show that the kraft sheets discolor perceptibly less when N,N-dibenylhydroxylamine and especially when N,N-diethylhydroxylamine are present along with the UV absorber CIBAFAST® W.

What is claimed is:

1. A composition having reduced loss of brightness and enhanced resistance to yellowing which comprises (a) a chemical paper which may still contain traces of lignin, and (b) an amount which is effective to reduce loss of brightness and enhance resistance to yellowing of an N,N-dialkylhydroxylamine, an ester, amide or thio substituted N,N-dialkylhydroxylamine or N,N-dibenzylhydroxylamine of formula I, II or III $$R_1R_2N—OH \quad (I)$$

$$(T_1SCH_2)(T_2SCH_2)N—OH \quad (II)$$

$$(E_1COCH_2CH_2)(E_2COCH_2CH_2)N—OH \quad (III)$$

where $R_1$ and $R_2$ are independently alkyl of 1 to 18 carbon atoms, alkyl of 1 to 18 carbon atoms substituted by a hydroxyl group; or benzyl;

$T_1$ and $T_2$ are independently alkyl of 1 to 4 carbon atoms, phenyl, 3,5-di-tert-butyl-4-hydroxy-phenyl, benzyl or —$CH_2COOH$;

$E_1$ and $E_2$ are independently —$OE_3$, —$NHE_3$ or —$NE_3E_4$ where $E_3$ and $E_4$ are independently hydrogen, alkyl of 1 to 4 carbon atoms or said alkyl substituted by one hydroxyl group; or of an acid salt of formula IA, IIA or IIIA $$(R_1R_2NH—OH)_h^+(X^-)_j \quad (IA)$$

$$[(T_1SCH_2)(T_2SCH_2)NH—OH]_h^+(X^{31})_j \quad (IIA)$$

$$[(E_1COCH_2CH_2)(E_2COCH_2CH_2)NH—OH]_h^+(X^-)_j \quad (IIIA)$$

where $R_1$, $R_2$, $T_1$, $T_2$, $E_1$ and $E_2$ are as defined above,

X is an inorganic or organic anion, and the total charge of cations h is equal to the total charge of anions j.

2. A composition according to claim 1 wherein component (a) is a kraft paper.

3. A composition according to claim 1 where in the formula IA, IIA or IIIA, X is phosphate, phosphonate, carbonate, bicarbonate, nitrate, chloride, bromide, bisulfite, sulfite, bisulfate, sulfate, borate, formate, acetate, benzoate, citrate, oxalate, tartrate, acrylate, polyacrylate, fumarate, maleate, itaconate, glycolate, gluconate, malate, mandelate, tiglate, ascorbate, polymethacrylate, a carboxylate of nitrilotriacetic acid, hydroxyethylethylenediaminetriacetic acid, ethylenediaminetetraacetc acid or of diethylenetriaminepentaacetic acid, a diethylenediaminetetraacetic acid or of diethylenetriaminepentaacetic acid, an alkylsulfonate or an arylsulfonate.

4. A composition according to claim 1 wherein the hydroxylamine of formula I, II or III is N,N-dimethylhydroxylamine, N,N-diethylhydroxylamine, N,N-bis(2-hydroxypropyl)hydroxylamine, N,N-bis(3-hydroxypropyl)hydroxylamine, N,N-dioctadecylhydroxylamine, the N,N-dialkylhydroxylamine product made by the direct oxidation of N,N-di (hydrogenated tallow)-amine, N,N-dibenzylhydroxylamine, N,N-bis(2-carboxyethyl)hydroxylamine or N,N-bis (benzylthiomethyl)hydroxylamine.

5. A composition according to claim 4 wherein the hydroxylamine is N,N-diethylhydroxylamine, N,N-bis(2-hydroxypropyl)hydroxylamine, N,N-bis(3hydroxypropyl) hydroxylamine or N,N-dibenzylhydroxylamine.

6. A composition according to claim 1 wherein component (b) is N,N-diethylhydroxylamine or tris(N,N-diethylhydroxylammonium) citrate.

7. A composition according to claim 1 which additionally includes an effective stabilizing amount of at least one stabilizer selected from the group consisting of the UV absorbers, the polymeric inhibitors, the sulfur containing inhibitors, the phosphorus containing compounds, the nitrones, the benzofuran-2-ones, fluorescent whitening agents, hindered amine hydroxylamines and salts thereof, hindered amine nitroxides and salts thereof, hindered amines and salts thereof, and metal chelating agents.

8. A composition according to claim 7 wherein the additional stabilizer is a UV absorber.

9. A composition according to claim 8 wherein the UV absorber is selected from group consisting of the benzotriazoles, the s-triazines, the benzophenones, the α-cyanoacrylates, the oxanilides, the benzoxazinones, the benzoates and the α-alkyl cinnamates.

10. A composition according to claim 8 wherein the UV absorber is a benzotriazole, an s-triazine or a benzophenone.

11. A composition according to claim 8 wherein the UV absorber is 3-(2H-benzotriazol-2-yl)-4-hydroxy-5sec-butylbenzene sulfonic acid, sodium salt (CIBAFAST® W).

12. A composition according to claim 7 wherein the additional stabilizer is a polymeric inhibitor.

13. A composition according to claim 12 wherein the polymeric inhibitor is poly(ethylene glycol), poly(propylene glycol), poly(butylene glycol) or poly(vinyl pyrrolidone).

14. A composition according to claim 7 wherein the additional stabilizer is a sulfur containing inhibitor.

15. A composition according to claim 14 wherein the sulfur containing inhibitor is polyethylene glycol dithiolacetate, polypropylene glycol dithiolacetate, polybutylene glycol dithioacetate, 1-thioglycerol, 2-mercaptoethyl ether, 2,2'thiodiethanol, 2,2'-dithiodiethanol, 2,2'oxydiethanethiol, ethylene glycol bisthioglycolate, 3mercapto-1,2-propanediol, 2-(2-methoxyethoxy)-ethanethiol, glycol dimercaptoacetate, 3,3'-dithiopropionic acid, polyethylene glycol dithiol, polypropylene glycol dithiol, polybutylene glycol dithiol or ethylene glycol bis (mercaptoacetate).

16. A composition according to claim 7 wherein the additional stabilizer is a phosphorus containing compound.

17. A composition according to claim 16 wherein the phosphorus containing compound is tris(2,4-di-tert-butylphenyl) phosphite, 2,2',2"-nitrilo[triethyl-tris(3,3',5,5'-tetra-tert-butyl-1,1'-biphenyl-2,2'-diyl) phosphite], tris(2,4di-tert-butyl-6-ethylphenyl) phosphite, sodium hydroxymethyl phosphinate, tetrakis(2,4-di-butylphenyl) 4,4'-biphenylenediphosphonite, tris(nonylphenyl) phosphite, bis(2,4-di-tert-butylphenyl) pentaerythrityl diphosphite, 2,2'-ethylidenebis(2,4-di-tert-butylphenyl) fluorophosphite or 2-butyl-2-ethylpropan-1,3diyl 2,4,6tri-tert-butylphenyl phosphite.

18. A composition according to claim 7 wherein the additional stabilizer is a mixture of a UV absorber and polymeric inhibitor.

19. A composition according to claim 7 wherein the additional stabilizer is a mixture of a UV absorber and a sulfur containing compound.

20. A composition according to claim 7 wherein the additional stabilizer is a mixture of a UV absorber and a phosphorus containing compound.

21. A composition according to claim 7 wherein the additional stabilizer is a mixture of a UV absorber and a metal chelating agent.

22. A composition according to claim 7 wherein the additional stabilizer is a mixture of a polymeric inhibitor and a sulfur containing compound.

23. A composition according to claim 7 wherein the additional stabilizer is a mixture of a polymeric inhibitor and a phosphorus containing compound.

24. A composition according to claim 7 wherein the additional stabilizer is a mixture of a sulfur containing compound and a phosphorus containing compound.

25. A composition according to claim 7 wherein the additional stabilizer is a mixture of a UV absorber, a polymeric inhibitor and a sulfur containing compound.

26. A composition according to claim 7 wherein the additional stabilizer is a mixture of a UV absorber, a polymeric inhibitor and a phosphorus containing compound.

27. A composition according to claim 7 wherein the additional stabilizer is a mixture of a UV absorber, a polymeric inhibitor and a metal chelating agent.

28. A composition according to claim 7 wherein the additional stabilizer is a mixture of a UV absorber, a polymeric inhibitor, a sulfur containing compound and a phosphorus containing compound.

29. A composition according to claim 7 wherein the additional stabilizer is a mixture of a UV absorber and a hindered amine nitroxide.

30. A composition according to claim 7 wherein the additional stabilizer is a mixture of a UV absorber and a hindered amine hydroxylamine.

31. A composition according to claim 7 wherein the additional stabilizer is a mixture of a UV absorber and a hindered amine hydroxylamine salt.

32. A composition according to claim 7 wherein the additional stabilizer is a mixture of a UV absorber and a hindered amine.

33. A composition according to claim 7 wherein the additional stabilizer is a fluorescent whitening agent.

34. A composition according to claim 33 wherein the fluorescent whitening agent is 2,2'-[(1,1'-diphenyl)-4,4'-diyl-1,2-ethenediyl]bis-benzenesulfonic, disodium salt {or bis[4,4'-(2-stilbenesulfonic acid)], disodium salt} (TINOPAL® SK).

35. A composition according to claim 1 wherein the effective stabilizing amount of the hydroxylamine or hydroxylamine salt is 0.001 to 5% by weight based on the paper.

36. A composition according to claim 1 wherein the effective stabilizing amount of the hydroxylamine is 0.005 to 4% based on the paper.

37. A composition according to claim 1 wherein the effective stabilizing amount of the hydroxylamine is 0.01 to 4% based on the paper.

38. A composition according to claim 7 wherein the effective stabilizing amount of a coadditive is 0.001 to 5% by weight based on the paper.

39. A composition according to claim 7 wherein the effective stabilizing amount of a coadditive is 0.005 to 3% by weight based on the paper.

40. A composition according to claim 7 wherein the effective stabilizing amount of a coadditive is 0.01 to 2% based on the paper.

41. A process for preventing the loss of brightness and for enhancing resistance to yellowing of a chemical paper which may still contain traces of lignin which comprises treating said paper with an amount which is effective to reduce loss of brightness and enhance resistance to yellowing of a hydroxylamine compound of formula I, II or III or hydroxylamine salt of formula IA, IIA or IIIA according to claim 1.

42. A process according to claim 41 wherein the paper is a kraft paper.

43. A process according to claim 41 wherein the hydroxylamine or hydroxylamine salt is N,N-diethylhydroxylamine or tris(N,N-diethylhydroxylammonium) citrate.

* * * * *